US007069880B2

(12) United States Patent
Hutchins

(10) Patent No.: US 7,069,880 B2
(45) Date of Patent: Jul. 4, 2006

(54) ENGINE COOLING SYSTEMS

(75) Inventor: William Richard Hutchins, Kenilworth (GB)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 11/077,539

(22) Filed: Mar. 7, 2005

(65) Prior Publication Data

US 2005/0199193 A1 Sep. 15, 2005

Related U.S. Application Data

(63) Continuation of application No. PCT/GB02/03587, filed on Aug. 18, 2003.

(51) Int. Cl.
*F01P 7/14* (2006.01)

(52) U.S. Cl. ..... 123/41.29; 123/41.31; 123/41.08; 237/12.4

(58) Field of Classification Search ..... 123/41.29, 123/41.31, 41.32, 41.33, 41.08; 237/5, 12.4
See application file for complete search history.

(56) References Cited

U.S. PATENT DOCUMENTS

| | | | | |
|---|---|---|---|---|
| 2,797,875 | A * | 7/1957 | Obermaier | 237/8 A |
| 5,619,957 | A * | 4/1997 | Michels | 123/41.44 |
| 6,325,026 | B1 * | 12/2001 | Suzuki | 123/41.1 |

FOREIGN PATENT DOCUMENTS

| | | | |
|---|---|---|---|
| DE | 4121379 | | 1/1992 |
| DE | 4121379 | A1 * | 1/1992 |
| EP | 0960759 | | 12/1999 |
| EP | 0960759 | A1 * | 12/1999 |
| EP | 0900924 | | 10/2003 |
| EP | 0908609 | | 11/2003 |
| GB | 1290764 | | 4/1970 |
| GB | 2290123 | | 12/1995 |
| GB | 2320552 | | 6/1998 |
| GB | 2366365 | | 3/2000 |
| JP | 2002227646 | | 8/2002 |

OTHER PUBLICATIONS

U.S. Appl. No. 2002/050251, filed May 5, 2002, Takahashi et al.

* cited by examiner

*Primary Examiner*—Noah P. Kamen
(74) *Attorney, Agent, or Firm*—Allan J. Lippa; Alleman Hall McCoy Russell & Tuttle LLP

(57) ABSTRACT

A heater diverter valve (20) is provided in an engine cooling system having a radiator and a circulating pump, The valve has a first inlet (31) connected to a heater so that coolant flowing through the engine and then through the heater is returned to the pump return line through the valve via the first inlet and an outlet (33). A second inlet (32) is connected to engine and transmission oil coolers so that coolant which flows from the engine supply line through the coolers is returned to the pump return line via the second inlet and the outlet. The valve includes a shuttle (24) which at lower coolant temperatures closes off the second inlet (32) to prevent coolant flow. The second inlet (32) is opened at higher temperatures when a wax type thermal actuator pushes the shuttle towards the first inlet (31).

19 Claims, 7 Drawing Sheets

ENGINE COOLING SYSTEMS

CROSS REFERENCE TO RELATED APPLICATIONS

This application is a continuation of PCT International Patent Application No. PCT/GB02/03587 filed on 18 Aug. 2003, which is a continuation of GB 0220521.9, filed on 4 Sep. 2002 and claims benefit thereof.

FIELD OF THE INVENTION

This invention relates to engine cooling systems particularly, but not exclusively, for motor vehicles having a liquid cooled engine.

BACKGROUND OF THE INVENTION

It is well known to provide a motor vehicle with a cooling system in which a pump circulates coolant through the engine, through a radiator to cool the coolant and through a cabin heater which can use the coolant warmed by the engine to provide heating for the vehicle. It is also known to use the coolant to cool one or more auxiliary heat exchangers such as an engine oil cooler.

It is a problem with such known arrangements that when the engine and the vehicle are both cold some of the heat generated by the engine on start-up is absorbed by the auxiliary heat exchangers. Not only does the engine not warm up as quickly as it might but also the supply of heat to the heater is diminished because of the relatively slow warm up.

SUMMARY OF THE INVENTION

According to a first aspect of the invention there is provided an engine cooling system comprising a primary cooling circuit having a radiator for cooling liquid coolant for the engine, a pump to circulate the coolant through an engine supply line to the engine, from the engine to the radiator and from the radiator back to the pump through a pump return line, an auxiliaries cooling circuit having at least one auxiliary heat exchanger for cooling one or more further liquids and arranged so that coolant can flow from the engine supply line through the or each auxiliary heat exchanger and be returned as an auxiliaries return flow into the pump return line and a heater circuit having a heater comprising a liquid to air heat exchanger and arranged so that coolant can flow from the engine supply line through the engine and then through the heater and be returned as a heater return flow into the pump return line, wherein a common control valve is provided between the auxiliary heat exchanger and the pump return line and between the heater and the pump return line to control both the auxiliaries return flow and the heater return flow.

Preferably, the common control valve is operable to prevent the auxiliaries return flow until the heater return flow reaches a first pre-determined temperature.

The common control valve may be operable to restrict the heater return flow when the heater return flow exceeds a second pre-determined temperature. Alternatively, the common control valve may be operable to restrict the heater return flow when a combination of the auxiliaries return flow and the heater return flow exceeds a second pre-determined temperature. In either case there may be substantially no heater return flow allowed when the heater return flow exceeds the second pre-determined temperature. This second pre-determined temperature is usually an indication that no heat output is being taken from the heater so this can be used to optimise the performance of the auxiliary heat exchanger.

Conveniently, the common control valve comprises a thermally-responsive actuator having a temperature sensitive portion that is exposed to at least one of said return flows, in which case the temperature sensitive portion may be exposed to only the heater return flow when the heater return flow is below the first pre-determined temperature. Alternatively, the temperature sensitive portion may be exposed to both the heater return flow and the auxiliaries return flow.

When the common control valve permits both the auxiliaries return flow and the heater return flow, the auxiliaries return and the heater return flows may be mixed prior to reaching said temperature sensitive portion so that the temperature sensed by the temperature sensitive portion is dependent upon a combination of the temperature and the flow rate of the heater return flow and the temperature and flow rate of the auxiliaries return flow.

The auxiliaries cooling circuit may comprise two or more of said auxiliary heat exchangers arranged in parallel. Typically the auxiliary heat exchangers include an engine oil cooler, one or more transmission oil coolers and/or a fuel cooler.

In a preferred arrangement the common control valve comprises a housing defining a valve chamber, a first inlet connecting the heater to the valve chamber for the heater return flow, a second inlet connecting the auxiliary heat exchanger to the valve chamber for the auxiliaries return flow, an outlet connected to the pump return line and a valve assembly mounted in the valve chamber, the valve assembly comprising a valve shuttle and a biasing means to bias the valve shuttle towards an auxiliaries closed position in which heater return flow through the first inlet to the outlet is substantially unrestricted while auxiliaries return flow through the second inlet is prevented. Where the common control valve includes the thermally-responsive actuator, the valve assembly may further comprise the thermally-responsive actuator, the thermally-responsive actuator being arranged to urge the valve shuttle against the biasing means to allow auxiliaries return flow through the second inlet to the outlet when the heater return flow reaches the first predetermined temperature while continuing to allow the heater return flow from the first inlet through to the outlet.

The valve shuttle may be arranged so that with increasing temperature of the heater return flow, it moves further against the biasing means to obstruct heater return flow through the first inlet when the heater return flow reaches the second predetermined temperature while continuing to allow the auxiliaries return flow from the second inlet through to the outlet.

Preferably, the valve shuttle has a main valve member which cooperates with the housing to close the second inlet. In such a case, when the valve shuttle is arrange so that it obstructs heater return flow through the first inlet when the heater return flow reaches the second predetermined temperature, the main valve member may be arranged to cooperate with the housing to obstruct the first inlet. Alternatively and under the same circumstances, the valve shuttle may have an ancillary valve member which cooperates with the housing to obstruct the first inlet.

The thermally-responsive actuator may comprises an actuator body fast with the valve shuttle and a pushrod extending from one end of the valve shuttle for cooperation with an abutment on the housing, the actuator body including said temperature sensitive portion. Conveniently, the abutment is in the second inlet.

The biasing means may be a helical spring. The helical spring may be axially guided by the housing, conveniently by being located in the first inlet. In such cases, the valve shuttle may have a fluted end portion which is engaged within the helical spring so that the valve shuttle is axially guided by the helical spring.

Conveniently, where the thermally-responsive actuator comprises an actuator body fast with the valve shuttle, the valve shuttle is shaped to allow coolant to directly contact the temperature sensitive portion of the actuator body. In such a case valve shuttle may be shaped to allow coolant to directly contact the temperature sensitive portion on the side of the main valve member towards the first inlet and on the side of the main valve member towards the second inlet. Alternatively, where the valve shuttle comprises the ancillary valve member, the valve shuttle may be shaped to allow coolant to directly contact the temperature sensitive portion of the actuator body between the main valve member and the ancillary valve member and on the side of the main valve member towards the first inlet.

The invention also provides, according to a second aspect thereof, a common control valve when used in an engine cooling system according to a said first aspect

BREIF DESCRIPTION OF THE DRAWINGS

The invention will now be described by way of example and with reference to the accompanying drawings, of which:

DETAILED DESCRIPTION

Figure 1:
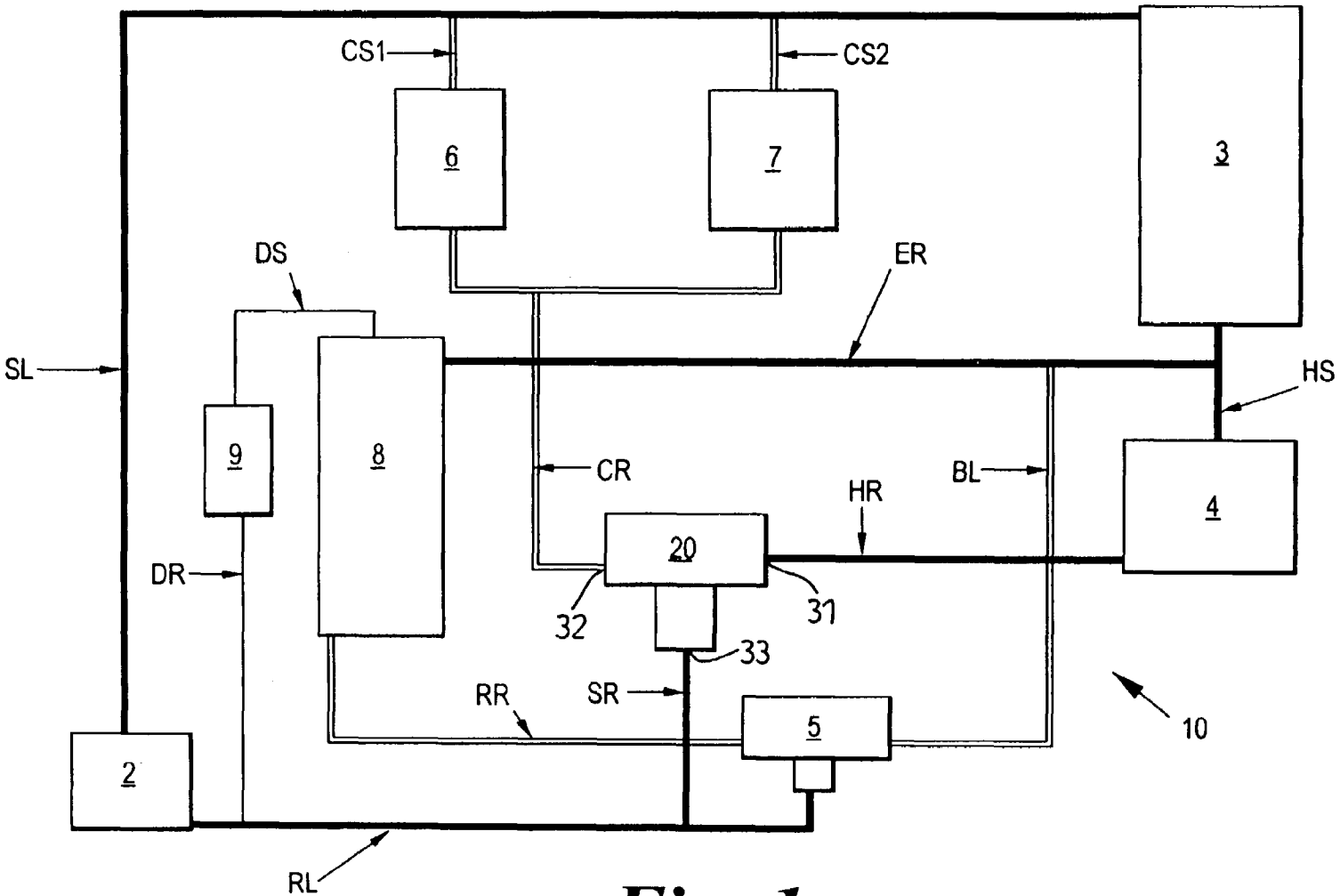
FIG. 1 is a diagrammatic representation of an engine cooling system according to the invention.

With particular reference to FIG. 1, a motor vehicle cooling system 10 comprises a primary cooling circuit having an air-cooled radiator 8 for cooling a liquid coolant for the engine 3. A pump 2 circulates the coolant through the engine 3 and then to the radiator 8 or to a bypass BL through an engine return line ER and back to the pump 2 through a primary flow control valve 5 and a pump return line RL. The primary flow control valve 5 is usually simply referred to as the thermostat. Here it will be referred to as the main thermostat 5 to avoid any confusion with other parts of the cooling system. An appropriate main thermostat 5 is described in EP-A-0794327 although conventional thermostats may be used. The bypass BL is arranged in parallel to the radiator 8 between the engine return line ER and the main thermostat 5. Coolant that has been cooled by the radiator 8 passes along a radiator return line RR to the main thermostat 5 and then back to the pump 2 through a pump return line RL. The main thermostat 5 controls the flow through the radiator 8, preventing flow until the engine 3 has reached an appropriate running temperature. However, as with most valves of this type, the main thermostat 5 also controls the flow in the bypass line BL. An expansion tank 9 is connected at an upper end to the top of the radiator 8 by a degas supply line DS and is connected at a lower end to the return line RL by a degas return line DR.

The engine cooling system 10 also includes an auxiliaries cooling circuit which comprises first and second liquid to liquid auxiliary heat exchangers in the form of a transmission oil cooler 6 and an engine oil cooler 7 connected in parallel between the engine supply line SL and a common control valve 20, more conveniently referred to as the heater diverter valve. Coolant is supplied to the transmission oil cooler 6 through a first cooler supply line CS1 and to the engine oil cooler 7 through a second cooler supply line CS2. The coolant outputs from the transmission oil cooler 6 and the engine oil cooler 7 are combined and fed as a coolers or auxiliaries return flow to the heater diverter valve 20 through a coolers return line CR.

Also included in the engine cooling system 10 is a heater circuit comprising a heater 4 having a liquid to air heat exchanger for vehicle cabin heating. The heater 4 is connected by a heater supply line HS to the engine return line ER between the engine 3 and the radiator 8. After flowing through the heater 4, the coolant is returned to the heater diverter valve 20 as a heater return flow through a heater return line HR. The coolers return flow and the heater return flow are returned to the primary cooling circuit at the pump return line RL through a secondaries return line SR.

Figure 2:
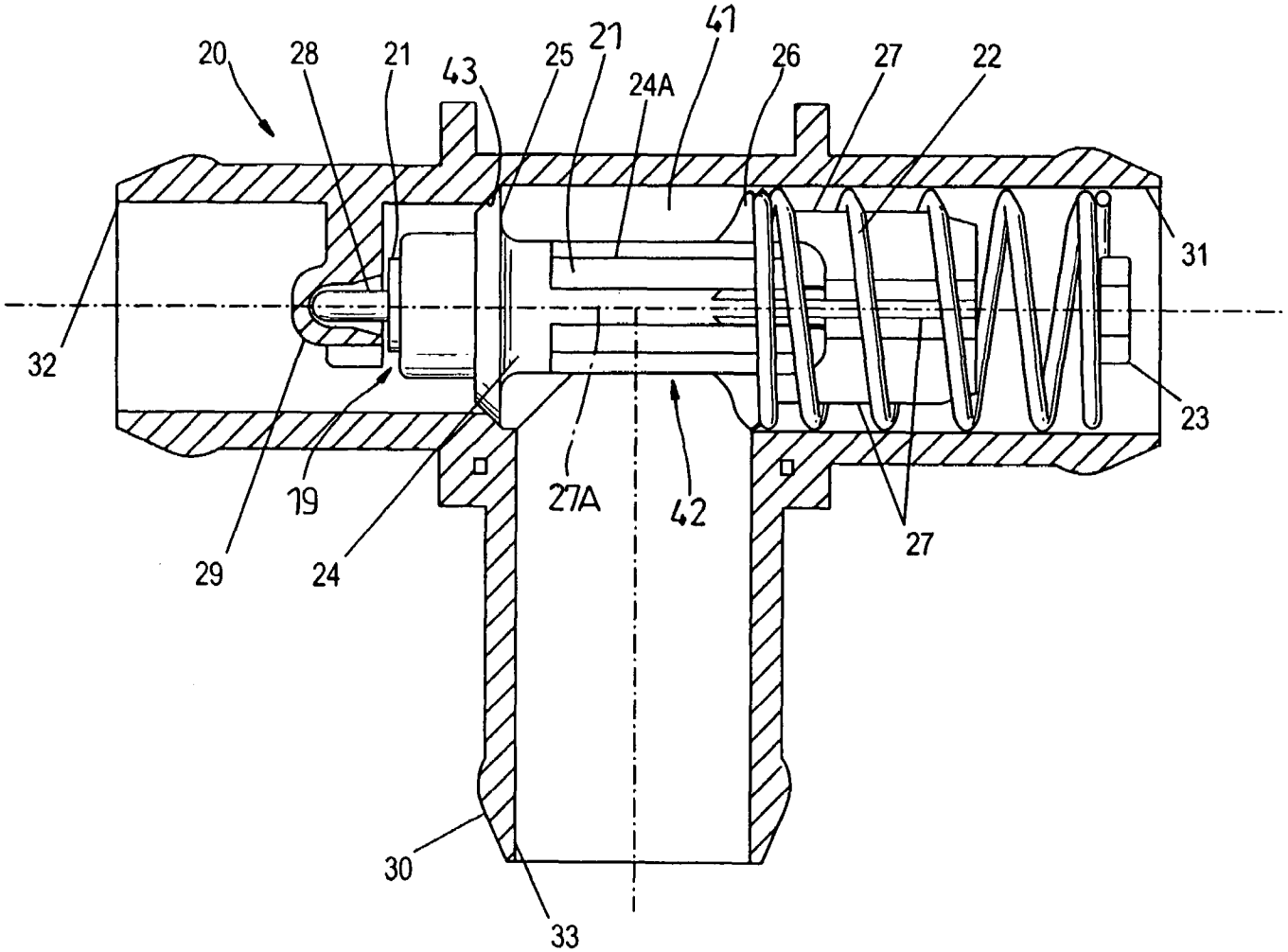
FIG. 2 is a cross-section through a common control valve shown in FIG. 1 with a valve shuttle in a first position.
Figure 3:
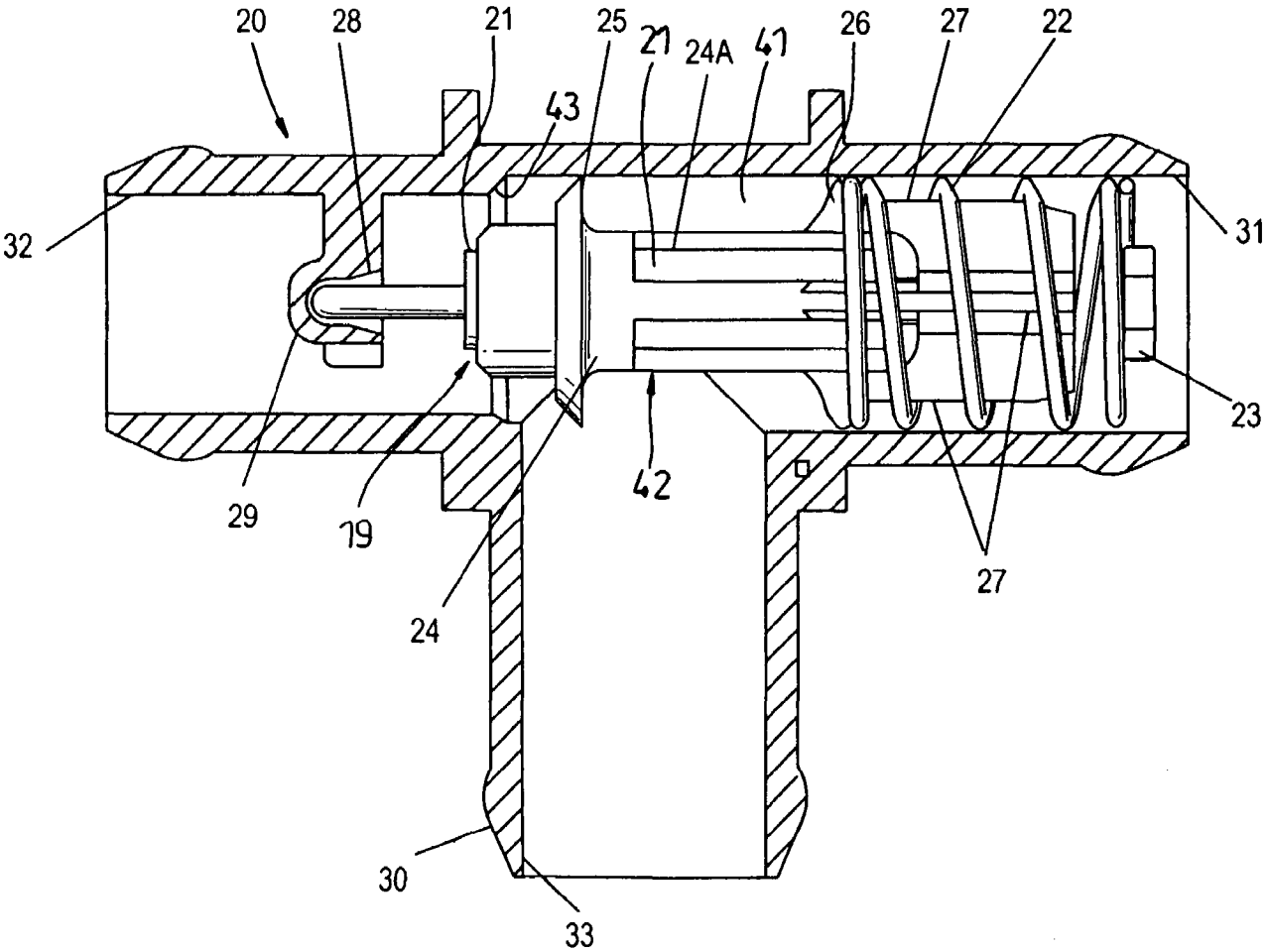
FIG. 3 is a cross-section based on FIG. 2 showing the valve shuttle in a second position.

With particular reference to FIGS. 2 and 3, the heater diverter valve 20 comprises a housing 30 made as a one-piece plastics moulding defining a valve chamber 41. A first inlet 31 connects the valve chamber 41 to the heater return line HR and a second inlet 32 connect the valve chamber 41 to the coolers return line CR. An outlet 33 is connected to the secondaries return line SR to return coolant to the primary cooling circuit. The housing 30 is in the form of a conventional tee-piece for connection to flexible hoses, the first and second inlets 31 and 32 being axially aligned and the outlet 33 having its axis perpendicular to that of the inlets.

A valve assembly 42 is carried in the valve chamber 41 and comprises a valve shuttle 24 formed as a plastics moulding and a thermally-responsive actuator 19 carried within the shuttle 24. A biasing means in the form of a helical spring 22 acts to bias the shuttle 24 towards the second inlet 32. The valve chamber 41 is formed as an extension of the bore of the first inlet 31 and at a step of this bore with the smaller bore of the second inlet 32 a chamfered valve seat 43 is formed for cooperation with a corresponding valve seat on a main valve member 25 formed as a collar integral with the shuttle 24.

The thermally-responsive actuator 19 is a generally conventional wax actuator (generally referred to as wax capsule) having an actuator or capsule body 21 and a pushrod 28 extending towards the second inlet 32 for cooperation with an abutment 29 in the second inlet 32. The abutment 29 is carried on three spokes and is formed as an integral part of the housing 30. The capsule body 21 has a metal casing which forms a temperature sensitive portion which can transmit heat to wax for driving the pushrod 28. The capsule body 21 is cylindrical, being a push fit in a bore of the shuttle 24 so that the capsule body is almost entirely within the shuttle 24. The shuttle 24 has four radial fins 27 which form a fluted end portion at is end adjacent the first inlet 31. Each fin 27 is aligned with a corresponding longitudinal rib 27A, the bore intersecting the ribs 27A to define four apertures 24A to the side of the main valve member 25 which is towards the first inlet 31. These apertures 24A allow heater return flow to directly contact the capsule casing 21.

Each fin 27 has a step 26 to provide a reaction surface for the helical spring 22. The helical spring 22 is a sliding fit on the fins 27 while the spring 22 is a sliding fit in the bore of first inlet 31. Hence the helical spring 22 acts as a guide for the valve shuttle 24. A ladder-shaped retainer 23 extends across the first inlet 31 through diametrically opposed windows in the housing 30 to provide a reaction surface for the helical spring 22.

Operation of the primary cooling circuit is conventional and thus will be described relatively briefly. When the engine 3 is started from cold it is desirable to increase its temperature as quickly as possible to reduce emissions and to increase fuel economy. During initial running of the engine, the main thermostat 5 prevents any coolant flowing through the radiator 8 while allowing flow through the bypass BL. Once the engine 3 has been operated for a sufficient period for it to have reached normal operating temperature, which in this case is 90°, the main thermostat 5 starts to close off the bypass BL to allow coolant to begin flowing through the radiator 8 and prevent the engine 3 from overheating.

Operation of the heater diverter valve 20 is as follows. Following a cold start of the engine 3, the valve 20 is in the state shown in FIG. 2. The main valve member 25 is held on the seat 43 by the spring 22 to shut off the coolers return flow from the second inlet 32 while the heater return flow through the first inlet 31 into the valve chamber 41 and through the outlet 33 is unrestricted. The temperature of the heater return flow is sensed by the capsule body 21 so that as the temperature of the heater return flow increases, the pushrod 28 starts to generate a force in opposition to the preload of the spring 22. However, the coolers return flow remains blocked while the coolant entering the chamber is below a first pre-determined temperature, in this case 74° C. At this temperature the force generated by the pushrod 28 overcomes the pre-load of the spring 22 and the shuttle 24 starts to move away from the second inlet 32 to allow the coolers return flow from the second inlet 32 to the outlet 33 while continuing to allow the heater return flow from the first inlet 31 to the outlet 33. As the temperature of the heater return flow continues to rise, the force generated by the wax actuator continues to increase and the shuttle 24 is moved further and further away from the second inlet 32, as shown in FIG. 3.

When the heater return flow reaches or exceeds a second pre-determined temperature, in this case 86° C., the pushrod 28 is fully extended and the valve member 25 is positioned more or less in the middle of the outlet 33. In this position it provides some restriction on the heater return flow from the first inlet 31 while allowing the least restriction to the coolers return flow from the second inlet 32.

By preventing coolers return flow following a cold start of the engine 3 until the temperature of the heater return flow reaches 74° C., the cooling system provides as much heat as possible to the heater 4 so that the occupants of the motor vehicle can obtain the maximum benefit from the heater 4. During this phase of operation the transmission oil cooler 6 and the engine oil cooler 7 are effectively isolated and do not absorb any of the heat being generated by the engine 3. Thus the time for the engine 3 to warm up is reduced, further helping the heater 4 to become effective more quickly. Furthermore, the usual situation following a cold start is that the temperature of the coolant in the engine supply line SL is above the temperatures of the oils flowing through the transmission oil cooler 6 and the engine oil cooler 7, even when the temperature of the heater return flow has risen above 74° C. and the heater diverter valve 20 has started to allow coolers return flow through the coolers return line CR. Under these conditions, the warmer coolant flowing through the auxiliaries cooling circuit heats these oils, thereby helping to reduce friction losses in the transmission and the engine 3. In due course the oil temperatures rise, the temperature of the coolers return flow becoming greater than that of the engine return flow in the engine supply line SL and the coolers 6 and 7 act to extract heat from the oils.

By restricting the heater return flow when the heater return flow reaches the second pre-determined temperature of 86° C., the pressure drop across the heater 4 is reduced so that the rate of coolant flow through the radiator 8 is increased. This reduces the temperature of the coolant circulated through the radiator return line RR, the main thermostat 5, the pump return line RL and the engine supply line to improve the effectiveness of the engine oil cooler 7 and the transmission oil cooler 6. When the vehicle is operating in a cool climate and the heater is likely to be in use, the temperature of the heater return flow is unlikely to reach 86° C. so the conditions just described tend to occur only when the ambient temperature is higher.

If the requirements for cabin heat from the heater 4 are reduced, there is a measurable increase in the temperature of the heater return flow and this is used to control operation of the heater diverter valve 20. When the heater 4 is supplying maximum cabin heat the temperature of the heater return flow is approximately 12° C. below the temperature when no heat is being supplied and this difference in temperatures can be used when designing the cooling system to determine the second pre-determined temperature of the heater return flow.

In the usual situation where the pump 2 is driven by the engine and pump speed is proportional to engine speed, the pressure of the coolant in the engine supply line SL increases with engine speed, thereby increasing both the flows and the pressure differences in the various parts of the cooling system. If for some reason the heater diverter valve 20 became inoperative (perhaps through failure of the wax capsule 21) so that the second inlet 32 remains closed there is a possibility that the engine and transmission oils would become of overheated. However, the pre-load of the helical spring can be set such that at low to moderate engine speeds the pre-load is sufficient to prevent flow through the second inlet 32 but at higher engine speeds the shuttle 24 is moved by the increasing pressure at the second inlet to allow some coolant flow through the oil coolers 6 and 7. Indeed, a cooling system which uses a heater diverter valve which has such a spring loaded valve shuttle without the thermally responsive actuator may provide a useful improvement over known cooling systems.

When the shuttle 24 moves away from the second inlet 32 to allow the coolers return flow from the second inlet 32 to the outlet 33, there is an additional advantage from merging the coolers return flow with the heater return flow in that the coolers return flow is through a relatively small cross-sectional area as it is carried past the main valve member 25 and this creates a venturi effect which can enhance the heaters return flow.

Figure 4:
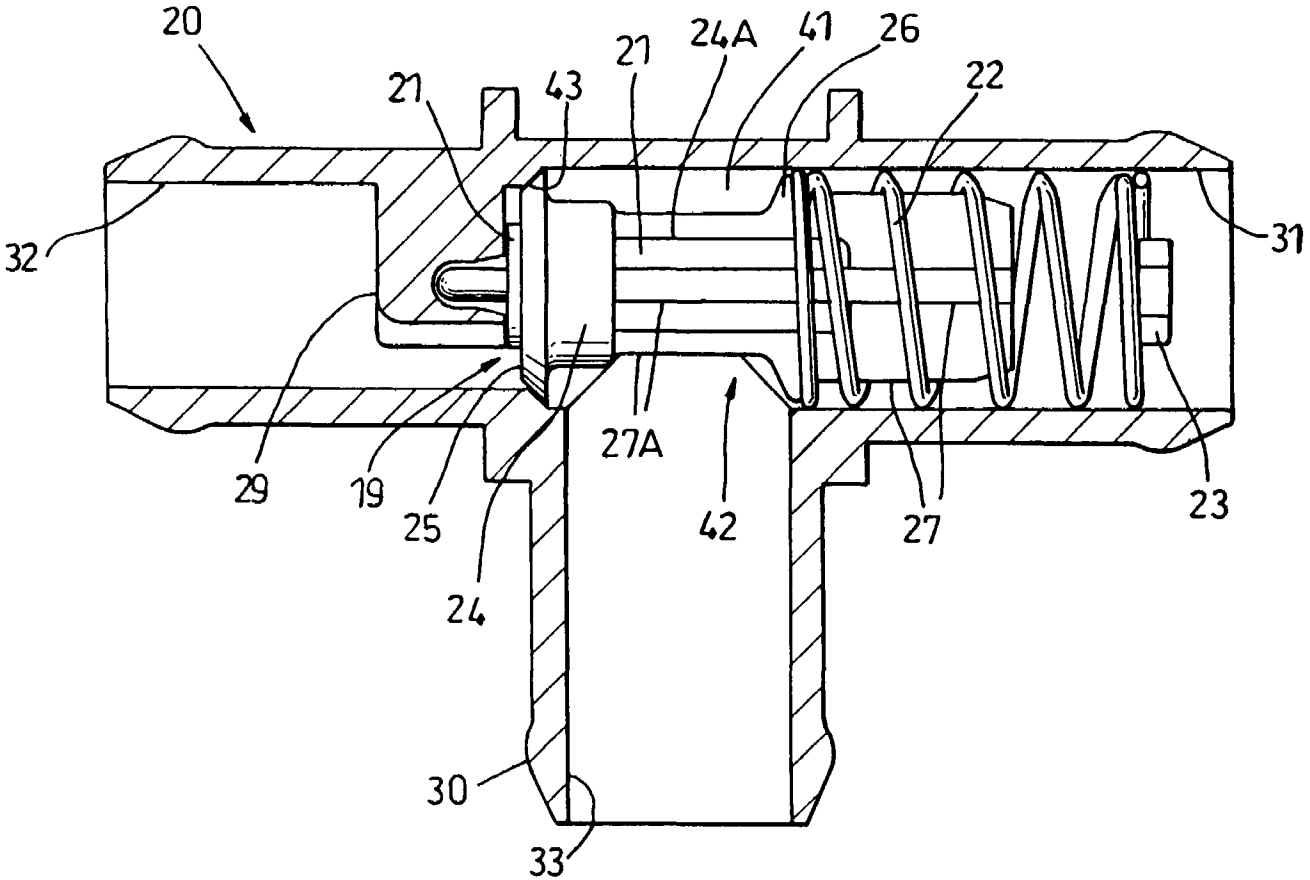
FIG. 4 is a cross-section based on FIG. 2 showing a first modification to the common control valve shown in FIGS. 2 and 3.

In the first modification shown in FIG. 4 most parts are the same as or similar to those in FIGS. 2 and 3 so carry the same reference. The main difference between this modified valve and the heater diverter valve 20 shown in FIGS. 2 and 3 is that the main valve member 25 is at the extreme end of the shuttle 24 closest to the second inlet 32. Also, the angle of the chamfer on the valve member 25 and the corresponding angle on the valve seat 43 are more acute. This allows the use of a shorter capsule body 21 and a shorter valve shuttle 24. Operation of the modified heater diverter valve 20 is otherwise the same as described above.

Figure 5:
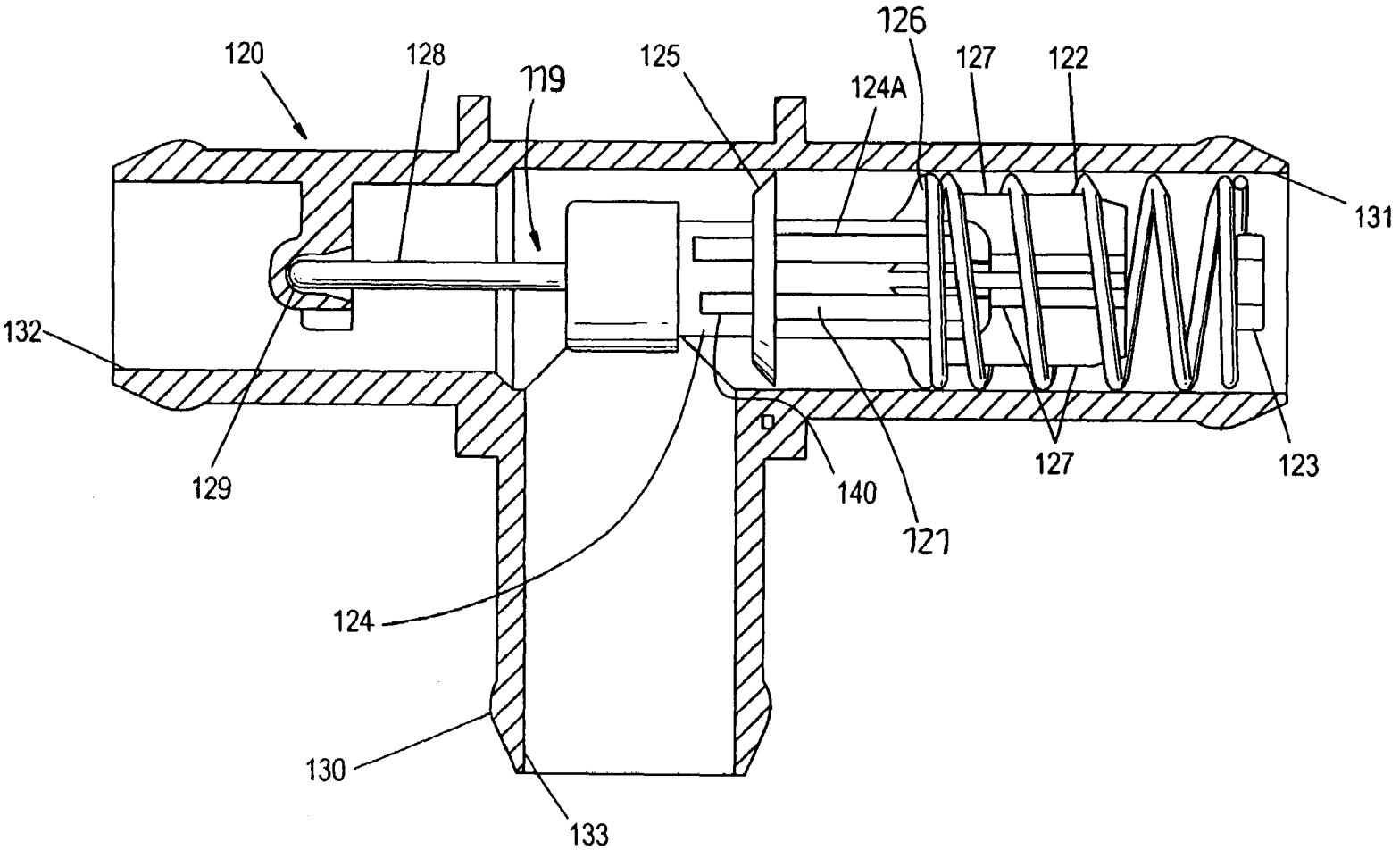
FIG. 5 is a cross-section based on FIG. 2 showing a second modification to the common control valve shown in FIGS. 2 and 3.

In the second modification shown in FIG. 5 parts which are the same as or similar to those in FIGS. 2 and 3 carry the same reference but with the addition of 100. Structurally, the main difference between the modified heater diverter valve 120 and the heater diverter valve 20 shown in FIGS. 2 and 3 is that the shuttle 124 is longer and has apertures 140 on the side of the valve member 125 to expose the capsule body 121 to the coolers return flow from the second inlet 132. Also, the pushrod 128 has a longer travel so that when it is at its maximum extension it pushes the valve member 125 a small distance into the bore of the first inlet 131.

Operation of this modified heater diverter valve 120 differs from that of the heater diverter valve 20 in that when the heater return flow from the first inlet 131 rises above the first predetermined temperature to unseat the valve member 125 and allow coolers return flow from the second inlet 132, then the capsule body 121 can draw significant heat from the coolers return flow as well as the heater return flow. The wax capsule 119 thus becomes responsive to a combination of the temperature and flow of the coolant entering through the first inlet 131 and the temperature and flow of the coolant entering through the second inlet. Before the valve member 125 becomes unseated, the coolant in the second inlet 132 is stagnant so the capsule 119 is at this stage responsive to only the temperature of the heater return flow entering through the first inlet 131.

As the temperatures of the heater return flow from the first inlet 131 and of the coolers return flow from the second inlet 132 continue to rise, the force generated by the capsule 119 continues to increase and the shuttle 124 and the valve member 125 are moved further and further away from the second inlet 132. When the coolant in the chamber reaches or exceeds the second pre-determined temperature the pushrod 128 is fully extended so that the valve member 125 is engaged with the first inlet 131 (as shown in FIG. 5) and so substantially shuts-off the heater return flow while allowing unrestricted coolers return flow from the second inlet 132. It will be appreciated that there may be a small flow in from the first inlet 131 due to clearance between the valve member 125 and the first inlet 131. The advantage of this arrangement is that it allows the maximum flow through the coolers 6 and 7 at very high coolant temperatures when hot air output from the heater 4 is an unlikely requirement.

As an alternative to the apertures 121 to the side of the valve member 125 towards the second inlet 132, the capsule body may be inserted in the bore of the shuttle 124 so that an end part adjacent the pushrod 128 remains exposed. This gives the same functionality as the apertures 121. A similar modification can be made to the heater diverter valves shown in FIGS. 2 and 3 and in FIG. 4 and can be readily made simply by inserting a spacer in the end of the bore of the shuttle 24.

Figure 6:
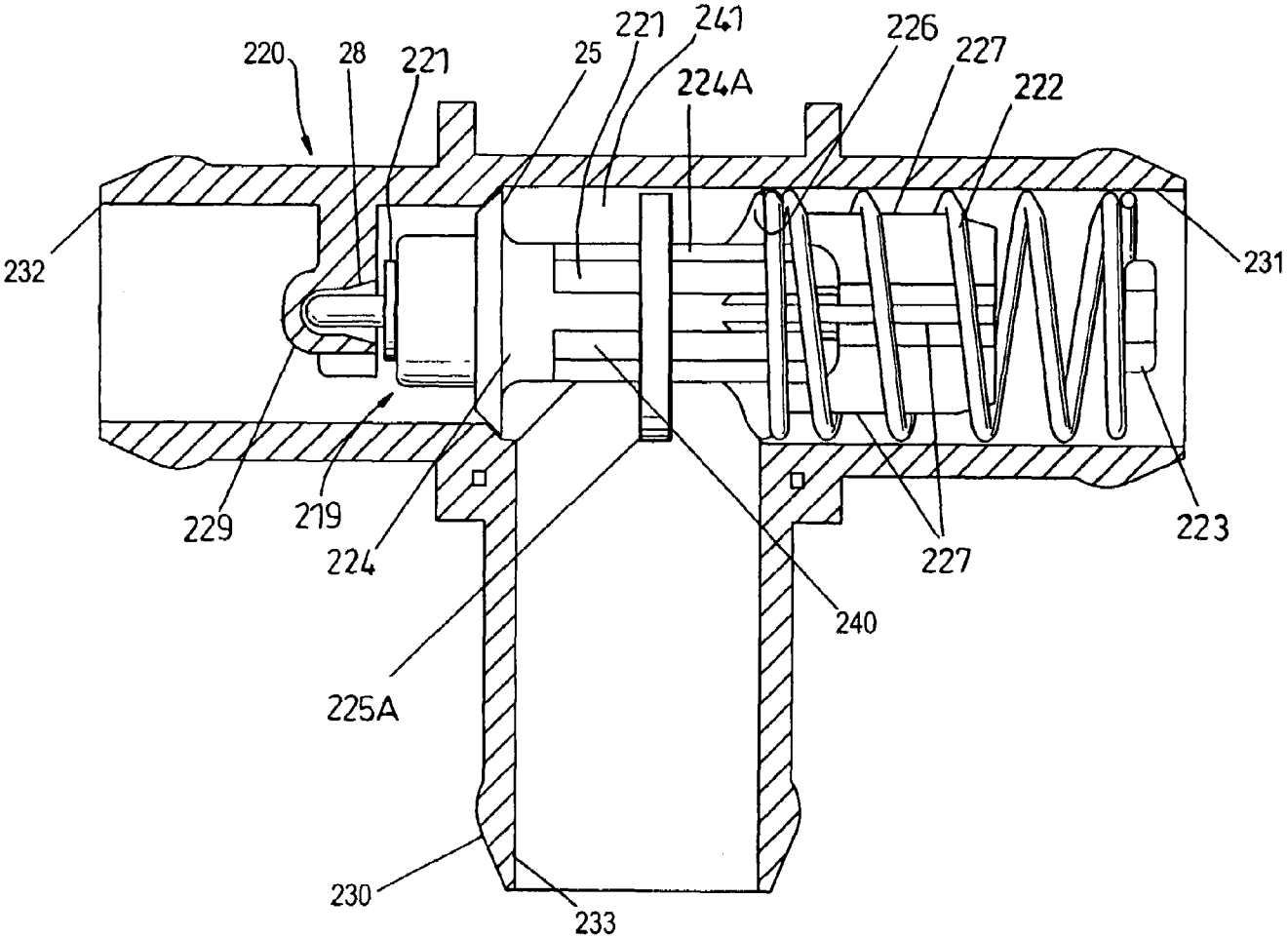
FIG. 6 is a cross-section based on FIG. 5 showing a third modification to the common control valve shown in FIGS. 2 and 3.

In the third modification shown in FIG. 6 parts which are the same as or similar to those in FIGS. 2 and 3 carry the same reference but with the addition of 200. Structurally, the main difference between this modified valve 220 and the heater diverter valve 20 shown in FIGS. 2 and 3 is that the shuttle 224 has an ancillary valve member 225A spaced from the main valve member 225 and has apertures 240 between the main valve member 225 and the ancillary valve member 225A to expose the capsule body 221 to the coolant in the valve chamber 241 in the region between the valve members 225 and 225A.

Operation of the heater diverter valve 220 differs from that of the valve 20 in that when the heater return flow from the first inlet 231 rises above the first predetermined temperature to unseat the main valve member 225 and allow coolers return flow from the second inlet 232, then the capsule body 221 can draw some heat from the coolers return flow as well as the heater return flow. The capsule 219 thus becomes responsive to a combination of the temperature and flow of the coolant entering through the first inlet 231 and the temperature and flow of the coolant entering through the second inlet 232. As the temperatures of the heater return flow and the coolers return flow continue to rise, the shuttle 224 moves further away from the second inlet 232. When the coolant in the valve chamber 241 reaches or exceeds the second pre-determined temperature the pushrod 228 is fully extended so that the ancillary valve member 225A is engaged with the bore of the first inlet 231 as is shown in respect of the further modification shown in FIG. 7. At this extent of travel of the shuttle 219, the ancillary valve member 225A substantially shuts-off the heater return flow while the main valve member 225 allows unrestricted coolers return flow. There may be a small flow through the first inlet 231 due to clearance between the ancillary valve member 225A and the bore of the first inlet 231. The advantage of this arrangement is similar to that of the FIG. 5 modification in that it allows the maximum flow through the coolers 6 and 7 at very high coolant temperatures when hot air output from the heater 4 is an unlikely requirement. However, it does not require a very large travel for pushrod 228 of the wax capsule 219.

Figure 7:
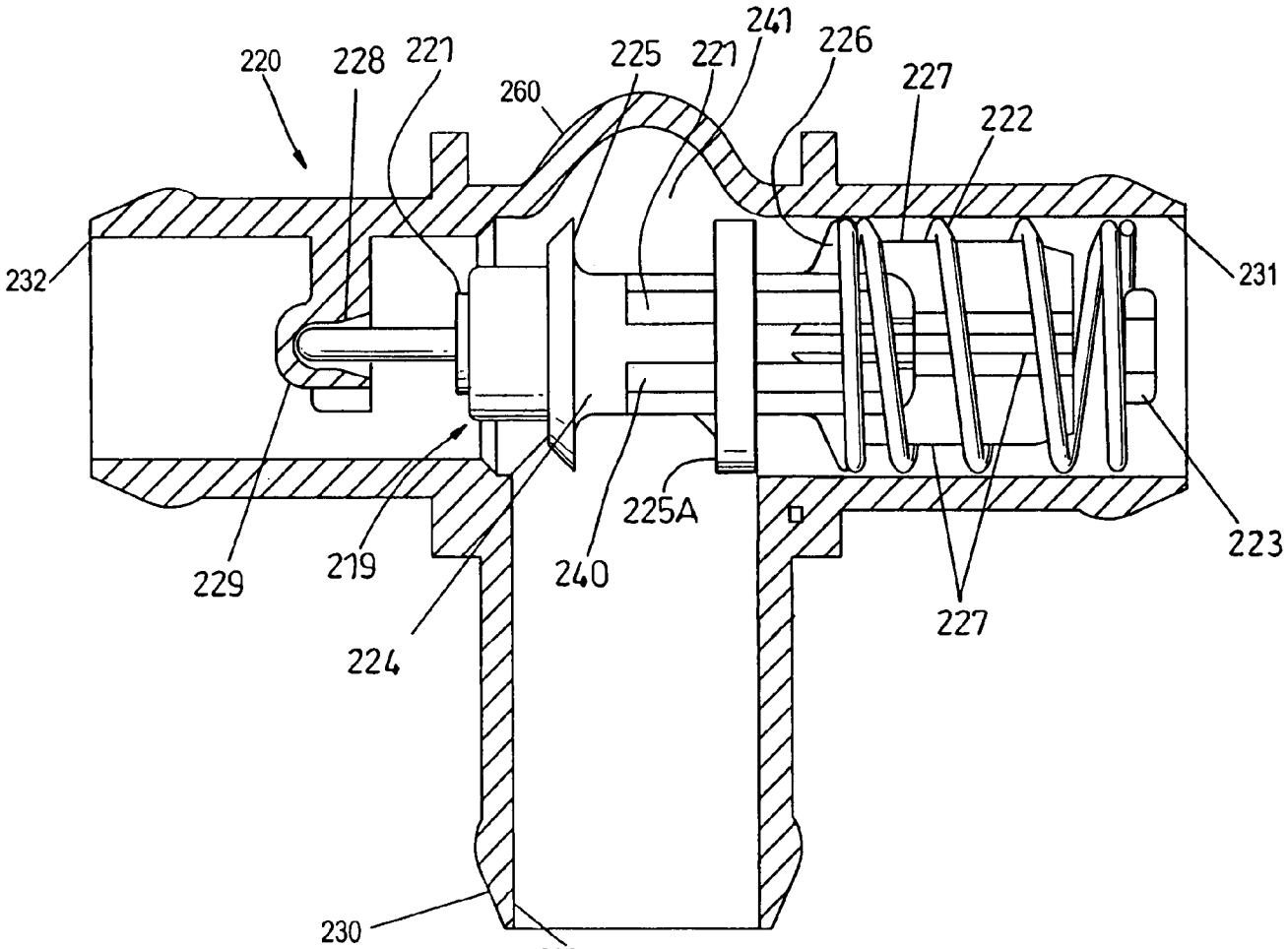
FIG. 7 is a cross-section based on FIG. 5 showing a fourth modification to the common control valve shown in FIGS. 2 and 3.

In the fourth modification shown in FIG. 7 all the parts except for the housing 230A are the same as those shown in FIG. 6 so carry the same reference. The main difference between the housing 230A and the housing 230 in FIG. 6 is a generally annular bulge 260 in the wall defining the valve chamber 241. This modification only affects the situation when the shuttle 224 is at an intermediate position and coolant is flowing in from the first and second inlets 231 and 232. The bulge 260 allows for a greater volume for the valve chamber 241 so that the coolers return flow and the heater return flow can mix prior to reaching the capsule casing 221. The temperature of the heater return flow remains dominant because it is able to directly impinge upon the capsule body 221 through the apertures 224A as well as mixing with the coolers return flow in the valve chamber 241.

Although the heater diverter valves 20, 120, 220 as described above all use a wax capsule type of thermally-responsive actuator, the actuator could be of some other thermally-responsive type, e.g. those using bi-metallic expansion or vapour pressure. Furthermore, the sensing of temperatures could be done through thermocouples or other temperature sensing means located to sense either heater return flow only or both the heater return flow and the coolers return flow and the control could be by means of a servo valve, either directly connected to the thermocouples or indirectly through an electronic control unit.

I claim:

1. An engine cooling system comprising:

a primary cooling circuit having an engine supply line, a pump return line, a radiator for cooling liquid coolant for the engine and a pump to circulate the coolant through said engine supply line to the engine, from the engine to said radiator and from said radiator back to said pump through said pump return line;

an auxiliaries cooling circuit having at least one auxiliary heat exchanger for cooling one or more further liquids and arranged so that coolant can flow from said engine supply line through said auxiliary heat exchanger and be returned as an auxiliaries return flow into said pump return line;

a heater circuit having a heater comprising a liquid to air heat exchanger and arranged so that coolant can flow from said engine supply line through the engine and then through said heater and be returned as a heater return flow into said pump return line; and a common control valve provided between said auxiliary heat exchanger and said pump return line and between said heater and said pump return line to control both said auxiliaries return flow and said heater return flow.

2. The cooling system of claim 1 in which said common control valve is operable to prevent said auxiliaries return flow until said heater return flow reaches a first pre-determined temperature.

3. The cooling system of claim 2 in which said common control valve is operable to restrict said heater return flow when said heater return flow exceeds a second predetermined temperature.

4. The cooling system of claim 2 in which said common control valve is operable to restrict said heater return flow when a combination of said auxiliaries return flow and said heater return flow exceeds a second predetermined temperature.

5. The cooling system of claim 2 in which said common control valve comprises a thermally-responsive actuator having a temperature sensitive portion that is exposed to only said heater return flow when said heater return flow is below said first predetermined temperature and which is exposed to both said heater return flow and said auxiliaries return flow when said heater return flow is above said first predetermined temperature.

6. The cooling system of claim 5 in which, when said heater return flow is above said first predetermined temperature, said auxiliaries return and said heater return flows are mixed prior to reaching said temperature sensitive portion so that temperature sensed by a temperature sensitive portion is dependent upon a combination of temperature and flow rate of said heater return flow and temperature and flow rate of said auxiliaries return flow.

7. The cooling system of claim 1 in which said common control valve comprises a housing defining a valve chamber, a first inlet connecting said heater to said valve chamber for said heater return flow, a second inlet connecting said auxiliary heat exchanger to said valve chamber for said auxiliaries return flow, an outlet connected to said pump return line and a valve assembly mounted in said valve chamber, said valve assembly comprising a valve shuttle and a biasing means to bias said valve shuttle towards an auxiliaries closed position in which heater return flow through said first inlet to said outlet is substantially unrestricted while said auxiliaries return flow through said second inlet is prevented.

8. The cooling system of claim 7 in which said common control valve is operable to prevent said auxiliaries return flow until said heater return flow reaches a first predetermined temperature, said valve assembly comprising a thermally-responsive actuator having a temperature sensitive portion that is exposed to only said heater return flow when said heater return flow is below said first predetermined temperature and which is exposed to both said heater return flow and said auxiliaries return flow when said heater return flow is above said first predetermined temperature, said thermally-responsive actuator being arranged to urge said valve shuttle againstsaid biasing means to allow said auxiliaries return flow through said second inlet to said outlet when said heater return flow reaches said first predetermined temperature while continuing to allow said heater return flow from said first inlet through to said outlet.

9. The cooling system of claim 8 in which said common control valve is operable to restrict said heater return flow when a combination of said auxiliaries return flow and said heater return flow exceeds a second predetermined temperature and arranged so that, with increasing temperature of said heater return flow, said valve shuttle moves further againstsaid biasing means to obstruct said heater return flow through said first inlet when said heater return flow temperature reaches said second predetermined temperature while continuing to allow said auxiliaries return flow from said second inlet through to said outlet.

10. The cooling system of claim 9 in which said valve shuttle has a main valve member which cooperates with said housing to close said second inlet when said heater return flow is below said first predetermined temperature and to obstruct said first inlet when said heater return flow temperature reaches said second predetermined temperature.

11. An engine cooling system comprising:

a primary cooling circuit having an engine supply line, a pump return line, a radiator for cooling liquid coolant for the engine and a pump to circulate coolant through said engine supply line to the engine, from the engine to said radiator and from said radiator back to said pump through said pump return line;

an auxiliaries cooling circuit having at least one auxiliary heat exchanger for cooling one or more further liquids and arranged so that coolant can flow from said engine supply line through said auxiliary heat exchanger and be returned as an auxiliaries return flow into said pump return line;

a heater circuit having a heater comprising a liquid to air heat exchanger and arranged so that coolant can flow from said engine supply line through the engine and then through said heater and be returned as a heater return flow into said pump return line; and a common control valve provided between said auxiliary heat exchanger and said pump return line and between said heater and said pump return line to control both said auxiliaries return flow and said heater return flow, said common control valve comprising a housing defining a valve chamber, a first inlet connecting said heater to said valve chamber for said heater return flow, a second inlet connecting said auxiliary heat exchanger to said valve chamber for said auxiliaries return flow, an outlet connected to said pump return line and a valve assembly mounted in said valve chamber, said valve assembly comprising a valve shuttle having a main valve member which cooperates with said housing to close said second inlet, an ancillary valve member which cooperates with said housing to obstruct said first inlet, a biasing means to bias said valve shuttle towards an auxiliaries closed position in which heater return flow through said first inlet to said outlet is substantially unrestricted while auxiliaries return flow through said second inlet is prevented, a thermally-responsive actuator having a temperature sensitive portion that is exposed to only said heater return flow when said heater return flow is below a first predetermined temperature and which is exposed to both said heater return flow and said auxiliaries return flow when said heater return flow is above said first predetermined temperature, said thermally-responsive actuator being arranged to urge said valve shuttle against said biasing means to allow said auxiliaries return flow through said second inlet to said outlet when said heater return flow reaches said first predetermined temperature while continuing to allow said heater return flow from said first inlet through to said outlet;

the arrangement being such that said common control valve is operable to restrict said heater return flow when a combination of said auxiliaries return flow and said heater return flow exceeds a second predetermined temperature and such that, with increasing temperature of said heater return flow, said valve shuttle moves further against said biasing means to obstruct heater return flow through said first inlet when said heater return flow temperature reaches said second predetermined temperature while continuing to allow said auxiliaries return flow from said second inlet through to said outlet.

12. The cooling system of claim 11 in which said valve shuttle is shaped to allow coolant to directly contact a temperature sensitive portion between said main valve member and said ancillary valve member and on a side of said main valve member towards said first inlet.

13. An engine cooling system comprising:

a primary cooling circuit having an engine supply line, a pump return line, a radiator for cooling liquid coolant for the engine and a pump to circulate coolant through said engine supply line to the engine, from the engine to said radiator and from said radiator back to said pump through said pump return line;

an auxiliaries cooling circuit having at least one auxiliary heat exchanger for cooling one or more further liquids and arranged so that coolant can flow from said engine supply line through said auxiliary heat exchanger and be returned as an auxiliaries return flow into said pump return line;

a heater circuit having a heater comprising a liquid to air heat exchanger and arranged so that coolant can flow from said engine supply line through the engine and then through said heater and be returned as a heater return flow into said pump return line; and a common control valve provided between said auxiliary heat exchanger and said pump return line and between said heater and said pump return line to control both said auxiliaries return flow and said heater return flow, said common control valve comprising a housing defining a valve chamber, a first inlet connecting said heater to said valve chamber for said heater return flow, a second inlet connecting said auxiliary heat exchanger to said valve chamber for said auxiliaries return flow, an outlet connected to said pump return line and an abutment, and a valve assembly mounted in said valve chamber, said valve assembly comprising a valve shuttle, a thermally-responsive actuator having an actuator body fast with said valve shuttle and a pushrod extending from one end of said valve shuttle for cooperation with an abutment, said actuator body including a temperature sensitive portion, and a biasing means to bias said valve shuttle towards an auxiliaries closed position in which heater return flow through said first inlet to said outlet is substantially unrestricted while auxiliaries return flow through said second inlet is prevented, said common control valve being operable to prevent said auxiliaries return flow until said heater return flow reaches a first predetermined temperature, a temperature sensitive portion being exposed to only said heater return flow when said heater return flow is below said first predetermined temperature and being exposed to both said heater return flow and said auxiliaries return flow when said heater return flow is above said first predetermined temperature.

14. The cooling system of claim 13 in which said abutment is in the second inlet.

15. The cooling system of claim 13 in which said biasing means is a helical spring which is axially guided by said housing and is located in said first inlet.

16. The cooling system of claim 15 in which said valve shuttle has a fluted end portion which is engaged within said helical spring so that said valve shuttle is axially guided by said helical spring.

17. The cooling system of claim 16 which said fluted end portion comprises elongated fins, each of said fins having a step formed at one end to form a reaction surface for said helical spring.

18. The cooling system of claim 13 in which said valve shuttle is shaped to allow coolant to directly contact a temperature sensitive portion of said actuator body.

19. The cooling system of claim 13 in which said valve shuttle has a main valve member which cooperates with said housing to close said second inlet and said valve shuttle is shaped to allow coolant to directly contact a temperature sensitive portion of said actuator body on a side of said main valve member towards said first inlet and on said side of said main valve member towards said second inlet.

* * * * *